US007849958B2

(12) United States Patent
Sato et al.

(10) Patent No.: US 7,849,958 B2
(45) Date of Patent: Dec. 14, 2010

(54) VIBRATION SYSTEM PART FOR SPEAKER DEVICE AND MANUFACTURING METHOD THEREOF

(75) Inventors: Masatoshi Sato, Yamagata (JP); Satoshi Hachiya, Yamagata (JP); Hiroyuki Kobayashi, Yamagata (JP); Koji Takayama, Yamagata (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 250 days.

(21) Appl. No.: 11/407,325

(22) Filed: Apr. 20, 2006

(65) Prior Publication Data

US 2006/0249327 A1 Nov. 9, 2006

(30) Foreign Application Priority Data

Apr. 21, 2005 (JP) ..... 2005-123620

(51) Int. Cl.

| | |
|---|---|
| ***H04R 7/02*** | (2006.01) |
| ***H04R 9/06*** | (2006.01) |
| ***H04R 11/02*** | (2006.01) |
| *G10K 13/00* | (2006.01) |
| *H04R 7/00* | (2006.01) |

(52) U.S. Cl. ..... 181/167; 181/169; 181/170; 381/426; 381/428

(58) Field of Classification Search ..... 181/167, 181/169, 170; 381/423, 426, 428
See application file for complete search history.

(56) References Cited

U.S. PATENT DOCUMENTS 4,140,203 A * 2/1979 Niguchi et al. ..... 181/167
4,410,768 A * 10/1983 Nakamura et al. ..... 381/423
5,744,761 A * 4/1998 Ogura et al. ..... 181/167
5,830,305 A 11/1998 Andersen et al.
6,039,145 A * 3/2000 Ogura et al. ..... 181/167
6,305,494 B1 * 10/2001 Pfaffelhuber et al. ..... 181/286
6,378,649 B1 * 4/2002 Inoue et al. ..... 181/167
6,591,938 B2 * 7/2003 Inoue et al. ..... 181/167

(Continued)

FOREIGN PATENT DOCUMENTS

DE 42 13 991 A1 11/1993

(Continued)

OTHER PUBLICATIONS

"Speaker cone Basalt fiber weaving cone", www.asianproducts.com, no date provided.*

(Continued)

*Primary Examiner*—Edgardo San Martin
(74) *Attorney, Agent, or Firm*—Young & Thompson

(57) ABSTRACT

A Vibration system part for a speaker device includes a woven fabric or a non-woven fabric made of basalt fiber produced by twist yarn or roving yarn being a continuous long-fiber. The vibration system part for the speaker device may be a diaphragm, a center cap, an edge or a damper, for example. In a preferred example, the woven fabric or the non-woven fabric is impregnated with thermosetting resin or thermoplastic resin. Additionally, a lamination member, such as paper, foam material, resin or a film, is preferably laminated (coated) on the woven fabric or the non-woven fabric. Thus, the vibration system parts for the speaker device, having excellent acoustic property and reliability, can be obtained at a low price.

20 Claims, 6 Drawing Sheets

<CHARACTERISTIC TABLE OF DIAPHRAGM FOR SPEAKER DEVICE>

| | SPECIFIC GRAVITY (Kg/m³) | YOUNG'S MODULUS (N/m²) | SOUND SPEED (m/s) | INTERNAL LOSS (tan δ) |
|---|---|---|---|---|
| BASALT FIBER | $1.71 \times 10^3$ | $9.57 \times 10^{10}$ | $2.37 \times 10^3$ | 0.024 |
| GLASS FIBER <COMPARATIVE EXAMPLE> | $1.69 \times 10^3$ | $9.02 \times 10^{10}$ | $2.31 \times 10^3$ | 0.019 |

U.S. PATENT DOCUMENTS

| | | | | |
|---|---|---|---|---|
| 6,740,202 | B2 * | 5/2004 | Ishigaki et al. | 162/218 |
| 6,831,876 | B1 * | 12/2004 | Cartwright | 367/152 |
| 2002/0160682 | A1 * | 10/2002 | Zeng et al. | 442/411 |
| 2004/0112672 | A1 * | 6/2004 | Ono et al. | 181/169 |
| 2004/0115439 | A1 | 6/2004 | Degroote | |

FOREIGN PATENT DOCUMENTS

| | | | |
|---|---|---|---|
| EP | 1 220 568 | A2 | 7/2002 |
| JP | 63232799 | A * | 9/1988 |
| JP | 63287298 | A * | 11/1988 |
| JP | 1-32855 | | 7/1989 |
| JP | 01270494 | A * | 10/1989 |
| JP | 8-90721 | | 4/1996 |
| JP | 2000-104043 | | 4/2000 |

OTHER PUBLICATIONS

"Basalt Fiber & Composite Materials Technology Development"; www.basaltfm.com/eng/fiber/info.html 2005.*

"Basalt Fibres", Textiles Magazine, vol. 27, No. 4, 1998, pp. 20-21, XP000824256.

* cited by examiner

FIG. 2A

<CHARACTERISTIC TABLE OF BASALT FIBER AND GLASS FIBER>

| | BASALT FIBER | GLASS FIBER |
|---|---|---|
| DENSITY ($Kg/m^3$) | 2800 | 2540 |
| HYGROSCOPIC PROPERTY (%) | 0.5 | 1.0 |
| ELASTIC MODULUS ($N/mm^2$) | 10000 | 7200 |
| SOUND ISOLATION PROPERTY | 0.9～0.99 | 0.8～0.93 |

FIG. 2B

<CHARACTERISTIC TABLE OF DIAPHRAGM FOR SPEAKER DEVICE>

| | SPECIFIC GRAVITY ($Kg/m^3$) | YOUNG'S MODULUS ($N/m^2$) | SOUND SPEED (m/s) | INTERNAL LOSS ($\tan\delta$) |
|---|---|---|---|---|
| BASALT FIBER | $1.71 \times 10^3$ | $9.57 \times 10^{10}$ | $2.37 \times 10^3$ | 0.024 |
| GLASS FIBER <COMPARATIVE EXAMPLE> | $1.69 \times 10^3$ | $9.02 \times 10^{10}$ | $2.31 \times 10^3$ | 0.019 |

FIG. 4A
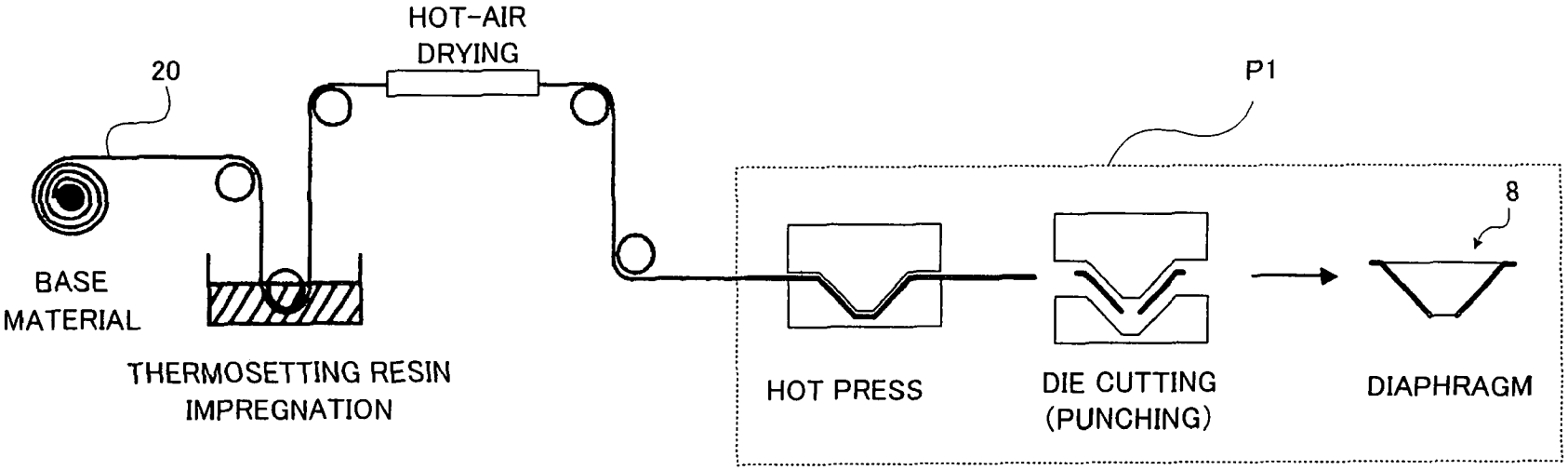
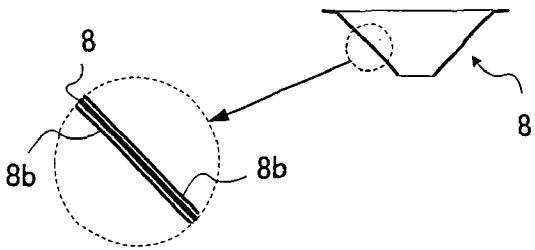
FIG. 4B

VIBRATION SYSTEM PART FOR SPEAKER DEVICE AND MANUFACTURING METHOD THEREOF

BACKGROUND OF THE INVENTION

1. Field of the Invention

The present invention relates to a component material of vibration system part for a speaker device.

2. Description of Related Art

Conventionally, as a fabric material of a diaphragm being a vibration system part for a speaker device, there is normally used a woven fabric or a non-woven fabric of inorganic fiber such as carbon fiber, glass fiber and ceramic fiber and an organic fiber such as aramid fiber and a PBO fiber (polypara phenylene benzobis imidazole fiber).

In addition, the fabric material of the above-mentioned fiber is generally used in such a state that the fabric material is impregnated with a thermosetting resin and then hardened by hot press. Additionally, the above fabric material of the fiber is sometimes used in such a state that a material, such as paper, foam and thermoplastic resin, is laminated on the surface thereof.

The fabric material to which such process is applied is formed into a predetermined shape by hot press, and is mounted on an outer peripheral wall of a voice coil bobbin as a diaphragm.

There is known a joint sheet forming composition including a fiber-type rock wool made of basalt (e.g., see Japanese Patent Application Laid-open under No. 2000-104043).

In addition, there is known a thermoplastic synthetic resin injection molded product including a reinforcement material including a rock wool microfilaments having a fiber diameter of 1 to 10 μm and fiber length of 60 to 600 μm, produced by processing a material mixture mixed or combined with basalt by a predetermined method, and fibrous potassium titanate having a fiber diameter of 0.1 to 0.7 μm and a fiber length of 10 to 50 μm (see Japanese Patent Publication No. 1-32855). Further, there is known a fiber board for architecture produced by processing and forming, by a predetermined method, a fiber-type rock wool, made of basalt by a known producing method, having a length of substantially 1 to 50 mm and a fiber diameter of 1 to 20 μm, (see Japanese Patent Application Laid-open under No. 8-90721).

Though the carbon fiber is excellent in its light weight and high rigidity, it is expensive. Further, since the carbon fiber has conductive property, an insulation treatment is necessary for a current-carrying part.

Though the ceramic fiber is excellent in its high rigidity, it is problematically expensive. Further, it is problematic that the ceramic fiber is easily broken at the time of processing.

Though ultra-high strength fiber such as the aramid fiber and the PBO fiber is excellent in its light weight and high internal loss, it is problematically expensive. Further, the ultra-high strength fiber is difficult to cut at the time of processing, and since it has hygroscopic property, it is easily deformed in the high-temperature and high-humidity atmosphere. The above-mentioned fibers are expensive fibers generally called "highly functional fiber".

A glass fiber being a general fiber is inexpensive, has no hygroscopic property and no conductive property, and has the high rigidity. Therefore, the glass fiber is used for an inexpensive diaphragm. However, since internal loss of the glass fiber is low, there is a problem to be solved in terms of sound quality.

SUMMARY OF THE INVENTION

The present invention has been achieved in order to solve the above problems. It is an object of this invention to provide a vibration system part for a speaker device, which is inexpensive and excellent in acoustic property and reliability, and a manufacturing method thereof.

According to one aspect of the present invention, there are provided a vibration system part for a speaker device including a woven fabric or a non-woven fabric made of basalt fiber produced by twist yarn or roving yarn being continuous long-fiber.

The above vibration system part for the speaker device includes the woven fabric or the non-woven fabric made of the basalt fiber produced by the twist yarn or the roving yarn being the continuous long-fiber. The vibration system part for the speaker device may be a diaphragm, a center cap, an edge or a damper, for example. In a preferred example, the woven fabric or the non-woven fabric may be impregnated with thermosetting resin or thermoplastic resin. In addition, a lamination member, e.g., paper, foam material, resin and a film, may be laminated (coated) on the woven fabric or the non-woven fabric.

Generally, while an elastic modulus of the glass fiber is 7200 ($N/mm^2$), an elastic modulus of the basalt fiber is 10000 ($N/mm^2$). Therefore, the basalt fiber has strength and rigidity higher than those of the glass fiber. Thus, the basalt fiber has internal loss and damping property (vibration absorbing property) higher than those of the glass fiber. As a result, in terms of the acoustic characteristic, the vibration system part for the speaker device including the basalt fiber as the woven fabric or the non-woven fabric is excellent as compared with the vibration system part for the speaker device including the glass fiber as the woven fabric or the non-woven fabric.

Generally, the basalt fiber is more expensive than the glass fiber, but it is less expensive than the highly functional fiber such as the carbon fiber and the ceramic fiber. Therefore, if the woven fabric or the non-woven fabric made of the basalt fiber is used as the component material of the vibration system part for the speaker device, it becomes possible to obtain the vibration system part for the speaker device at a low price.

In addition, an aramid fiber has such problems that it has the high hygroscopic property and it is therefore easily deformed in the high-temperature and high-humidity atmosphere. The carbon fiber has such a problem that, since it has the conductive property, the insulation treatment is necessary for the current-carrying part. On the contrary, since the hygroscopic property of the basalt fiber is small (substantially 0.5%), the basalt fiber is hardly deformed. Additionally, since the basalt fiber has no conductive property, the insulation treatment is unnecessary for the current-carrying part. Hence, if the woven fabric or the non-woven fabric made of the basalt fiber is used as the component material of the vibration system part for the speaker device, it becomes possible to obtain the vibration system part for the speaker device having excellent reliability.

As described above, since the vibration system part for the speaker device include the woven fabric or the non-woven fabric made of the basalt fiber produced by the twist yarn or the roving yarn being the continuous long-fiber, they are inexpensive, and they have the excellent acoustic property and reliability.

In a preferred example, an average diameter of the basalt fiber may be substantially 7 to 20 μm. When the average diameter of the basalt fiber is equal to or smaller than 6 μm, there is a following problem. Namely, in a manufacturing process of the basalt fiber, first, basalt being the material is melted, and then the melted basalt is taken out of a processing nozzle, and the basalt fiber is produced. At this time, the basalt fiber can be easily cut. As a result, the manufacturing the basalt fiber problematically becomes difficult. Meanwhile, when the average diameter of the basalt fiber is equal to or larger than 21 μm, there is a following problem. Namely, at the time of the processing of the basalt fiber, it is problematic that the basalt fiber can be easily broken. Further, when the fabric produced by the basalt fiber having the average diameter of 7 to 20 μm is compared with the fabric produced by the basalt fiber having the average diameter equal to or larger than 21 μm in the same density, the number of roving yarn of the latter becomes smaller than that of the former. As a result, the internal loss of the latter, occurring due to the shift between the fibers, problematically becomes small. Hence, it is preferable that the average diameter of the basalt fiber is substantially 7 to 20 μm.

According to another aspect of the present invention, there is provided a manufacturing method of a vibration system part for a speaker device including such a process that a woven fabric or a non-woven fabric made of basalt fiber produced by twist yarn or roving yarn being continuous long-fiber is impregnated with an impregnation material of thermosetting resin or thermoplastic resin and is then formed by hot press or hot suction. In a preferred example, the process may include such a process that a lamination member, e.g., paper, foam material, resin or a film, is laminated on the surface of the formed woven fabric or the formed non-woven fabric.

Thereby, it becomes possible to produce the vibration system part for the speaker device having the excellent acoustic property and reliability at a low price.

The nature, utility, and further features of this invention will be more clearly apparent from the following detailed description with respect to preferred embodiment of the invention when read in conjunction with the accompanying drawings briefly described below.

BRIEF DESCRIPTION OF THE DRAWINGS

FIGS. 2A and 2B are tables showing characteristics of a diaphragm as an example of the vibration system part for the speaker device;

FIG. 4A shows a diagram of each of processes corresponding to an impregnating process S2 and a forming process S3 shown in FIG. 3;

FIG. 4B shows a cross section of an example of a vibration system part of the speaker device laminated with a lamination member;

DETAILED DESCRIPTION OF THE PREFERRED EMBODIMENTS

The preferred embodiments of the present invention will now be described below with reference to the attached drawings.

[Configuration of Vibration System Parts for Speaker Device]

Figure 1:
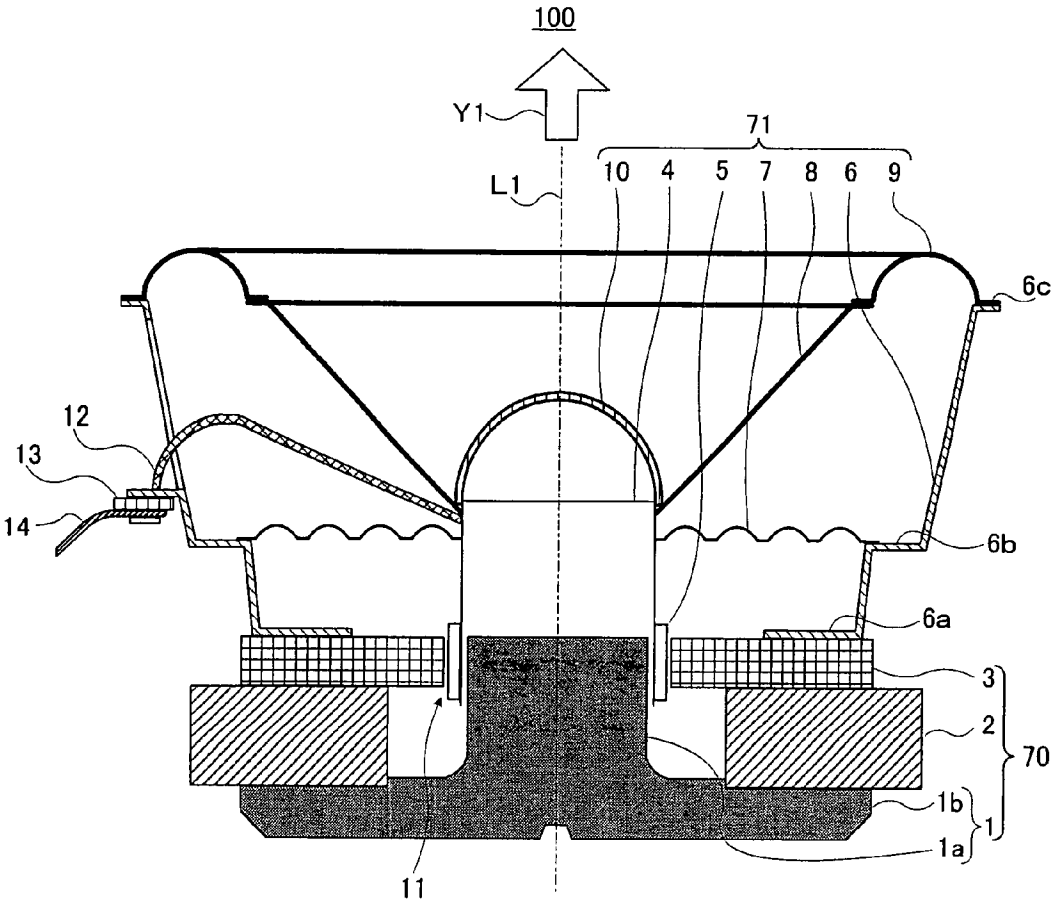
FIG. 1 shows a cross-sectional view of a speaker device including a vibration system part for a speaker device of the present invention.

FIG. 1 shows a cross-sectional view of a speaker device 100 including the vibration system parts for the speaker device of the present invention when cut by a plane including a central axis L1.

As shown in FIG. 1, the speaker device 100 mainly includes a magnetic circuit 70 having a yoke 1, a magnet 2 and a plate 3, and a vibration system 71 (hereinafter, also referred to as "vibration system parts for a speaker device") having a voice coil bobbin 4, a voice coil 5, a frame 6, a damper 7, a diaphragm 8, an edge 9 and a center cap 10. In the present invention, a configuration and a driving system of the speaker device, shapes, positions and sizes of the vibration system parts for the speaker device are not limited to configurations which will be described below.

First, a configuration of the magnetic circuit 70 will be explained.

The magnetic circuit 70 is configured as an external magnet type magnetic circuit. The yoke 1 has a pole portion 1*a* formed into a cylindrical shape and a flange portion 1*b* outwardly extending from a lower end portion of an outer peripheral wall of the pole portion 1*a*. The magnet 2, which is formed into an annular shape, is mounted on the flange portion 1*b*. The plate 3, which is formed into an annular shape, is mounted on the magnet 2. The magnetic flux of the magnet 2 is concentrated on a space (magnetic gap 11) formed between the outer peripheral wall of the pole portion 1*a* being a component of the yoke 1 and an inner peripheral wall of the plate 3.

Next, a configuration of the vibration system 71 will be explained.

The voice coil bobbin 4, formed into a cylindrical shape, is provided at a position covering the vicinity of the upper end portion of the outer peripheral wall of the pole portion 1*a* being the component of the yoke 1.

The voice coil 5 has one wiring, which includes a plus lead wire and a minus lead wire (not shown), and it is wound around the vicinity of a lower end portion of an outer peripheral wall of the voice coil bobbin 4. The plus lead wire is an input wiring for an L (or R)-channel signal, and the minus lead wire is an input wiring for a ground (GND: ground) signal. Each of the plus lead wire and the minus lead wire is connected to one end of each tinsel cord 12, and other end of each tinsel cord 12 is connected to a terminal portion 13 provided at a middle flat portion 6*b* of the frame 6, which will be described later. In addition, the terminal portion 13 is also connected to an output wiring 14 of an amplifier. Thereby, the signal and the power of one channel are inputted to the voice coil 5 from the amplifier via the terminal portion 13, each tinsel cord 12, the plus lead wire and the minus lead wire.

The frame 6 is formed into a substantial cup shape and has a function of supporting various kinds of component parts of the speaker device 100. The frame 6 has a lower flat portion 6*a* at a position on a lower side thereof, a middle flat portion 6*b* at a middle portion thereof, and an upper flat portion 6*c* at a position on an upper side thereof, respectively. The lower flat portion 6*a*, the middle flat portion 6*b* and the upper flat portion 6*c* have flatness, respectively. The lower flat portion 6*a* of the frame 6 is mounted on the plate 3.

The damper 7, which is formed into an annular shape, elastically supports the voice coil bobbin 4. An inner peripheral edge portion of the damper 7 is mounted on the vicinity of an upper end portion of the outer peripheral wall of the voice coil bobbin 4. An outer peripheral-edge portion of the damper 7 is mounted on the middle flat portion 6*b* of the frame 6.

The diaphragm 8 has a function of outputting an acoustic wave corresponding to the input signal. The diaphragm 8 is formed into a cone shape. An inner peripheral edge portion of the diaphragm 8 is mounted on the upper end portion of the outer peripheral wall of the voice coil bobbin 4 at the upper side of the damper 7.

The edge 9 has an annular plan shape and an Ω shaped cross-section shape, and it has a function of absorbing an unnecessary vibration generated in the speaker device 100. An inner peripheral edge portion of the edge 9 is mounted on the outer peripheral edge portion of the diaphragm 8, and an outer peripheral edge portion of the edge 9 is mounted onto the upper flat portion 6*c* of the frame 6.

The center cap 10 is formed into a hemispherical shape and has a function of preventing dust and water from entering the inside of the speaker device 100. The center cap 10 is arranged at a position covering the upper surface of the voice coil bobbin 4 and is mounted on the upper end portion of the outer peripheral wall of the voice coil bobbin 4.

In the speaker device 100 having the above-mentioned configuration, the electric signal outputted from the output wiring 14 of the amplifier is supplied to the voice coil 5 via the terminal portion 13, each tinsel cord 12 and the plus and minus lead wires of the voice coil 5. Thereby, the driving force of the voice coil 5 is generated in the magnetic gap 11, which vibrates the diaphragm 8 in the direction of the central axis L1 of the speaker device 100. In this manner, the speaker device 100 outputs the acoustic wave in the direction of an arrow Y1.

[Component Material of Vibration System Parts for Speaker Device]

The present invention is characterized by the component material of the vibration system parts for the speaker device. The vibration system part for the speaker device to which the present invention is applied can be the diaphragm 8, the center cap 10, the damper 7 and the edge 9.

The vibration system part for the speaker device includes the woven fabric or the non-woven fabric made of the basalt fiber produced by the twist yarn (twist) or the roving yarn (roving) which are the continuous long-fiber. In a preferred example, the vibration system part for the speaker device is formed in such a manner that the woven fabric or the non-woven fabric made of the basalt fiber produced by the twist yarn or the roving yarn being the continuous long-fiber is impregnated with the thermosetting resin or the thermoplastic resin, and is then formed by hot press forming or vacuum forming. In another preferred example, the surface of the formed vibration system part for the speaker device is laminated (coated) with the lamination member such as the paper, the form material, the resin and the film. FIG. 4B shows an example of the diaphragm 8, being the vibration system part of the speaker device, on which the lamination member 8*b* is laminated. In still another preferred example, the average diameter (thickness) of the basalt fiber included in the woven fabric is substantially 7 to 20 μm for the reason described above.

Thereby, it becomes possible to obtain the vibration system parts for the speaker device having the excellent acoustic property and reliability at a low price.

As for this point, a detailed explanation will be given with reference to FIG. 2A. FIG. 2A shows a table showing normal characteristics of the glass fiber and the basalt fiber.

As shown in FIG. 2A, while the elastic modulus of the glass fiber is 7200 ($N/mm^2$), the elastic modulus of the basalt fiber is 10000 ($N/mm^2$) Therefore, it can be said that the basalt fiber has higher strength and rigidity as compared with the glass fiber. Hence, the basalt fiber has higher internal loss and damping property (vibration absorbing property) as compared with the glass fiber. As a result, the acoustic property of the vibration system parts for the speaker device in which the basalt fiber is used as the woven fabric or the non-woven fabric is excellent as compared with that of the vibration system parts for the speaker device in which the glass fiber is used as the woven fabric or the non-woven fabric.

In addition, though the basalt fiber is generally more expensive than the glass fiber, it is much less expensive than the highly functional fiber such as the carbon fiber and the ceramic fiber. Therefore, if the woven fabric or the non-woven fabric made of the basalt fiber produced by the twist yarn or the roving yarn being the continuous long-fiber is used as the component material of the vibration system parts for the speaker device, the vibration system parts for the speaker device can be obtained at a low price.

As described above, it is problematic that the aramid fiber has the high hygroscopic property and is easily deformed in the high-temperature and high-humidity atmosphere. Additionally, it is problematic that, since the carbon fiber has the conductive property, the insulation treatment is necessary for the current-carrying part. On the contrary, as shown in FIG. 2A, since the hygroscopic property of the basalt fiber is 0.5%, which is small, it is hardly deformed. In addition, since the basalt fiber has no conductive property, the insulation treatment is unnecessary for the current-carrying part. As a result, by using the woven fabric or the non-woven fabric made of the basalt fiber produced by the twist yarn or the roving yarn being the continuous long-fiber as the component material of the vibration system parts for the speaker device, it becomes possible to obtain the vibration system parts for the speaker device having the excellent reliability.

[Preferred Example]

Next, a description will be given of a preferred example of the diaphragm 8 as an example of the vibration system parts for the speaker device.

In this preferred example, the diaphragm 8 is manufactured in such a manner that the woven fabric including the basalt fiber produced by the twist yarn or the roving yarn being the continuous long-fiber is impregnated with a phenol resin as the thermosetting resin and is then formed by the hot press. The woven fabric is woven with using bundles of yarn of the basalt fiber having the average diameter (thickness) of substantially 7 to 20 μm. Each characteristic of the diaphragm 8 thus produced is shown in a table shown in FIG. 2B. Each characteristic of the diaphragm according to a comparative example is also shown in FIG. 2B. The diaphragm according to the comparative example is manufactured in such a manner that the woven fabric made of the glass fiber is impregnated with the phenol resin and is then formed by the hot press. The woven fabric is woven by bundles of yarn of the glass fiber having the average diameter (thickness) of substantially 7 to 20 μm.

As understood by comparing each characteristic of the diaphragm 8 being the preferred example of the present invention with each characteristic of the diaphragm 8 of the comparative example, Young's modulus and internal loss of the diaphragm 8 according to the preferred example are particularly higher than those of the comparative example. Therefore, it is understood that the acoustic characteristic of the diaphragm 8 according to the preferred example of the present invention is excellent as compared with that of the comparative example. Namely, since the diaphragm 8 according to the preferred example of the present invention is produced in such a manner that the woven fabric made of the basalt fiber produced by the twist yarn or the roving yarn being the continuous long-fiver is impregnated with the phenol resin as the thermosetting resin and is formed by the hot press, it has the excellent acoustic characteristic.

[Manufacturing Method of Vibration System Parts for Speaker Device]

Next, a description will be given of a manufacturing method of the vibration system parts for the speaker device with reference to FIG. 3 to FIGS. 6A to 6C.

Figure 3:
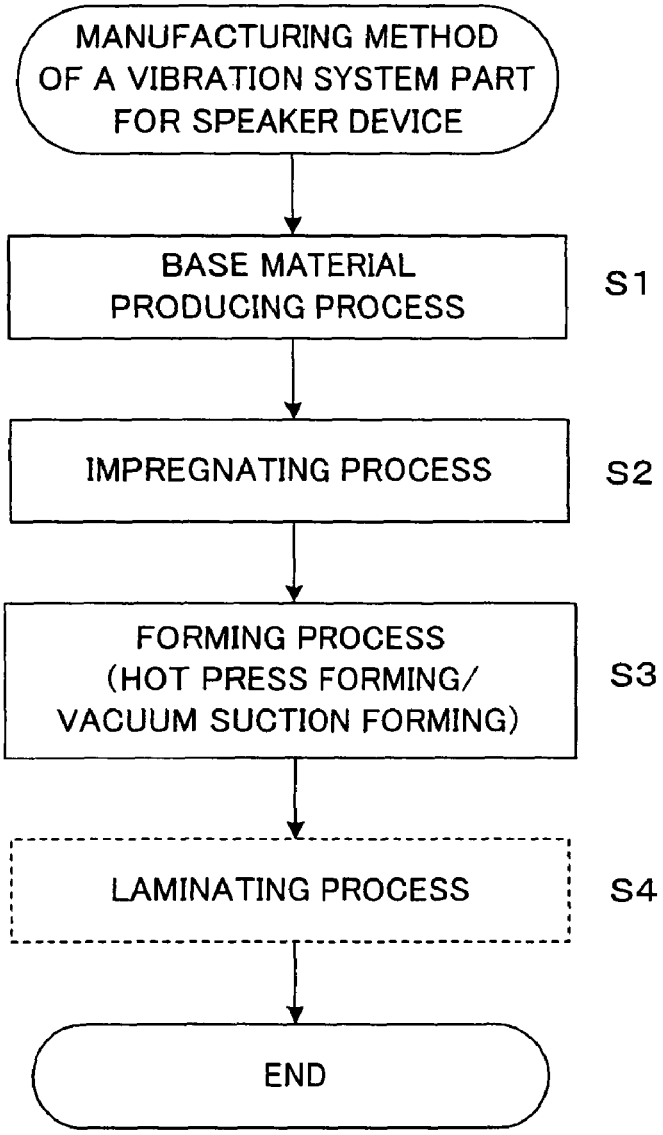
FIG. 3 is a flow chart showing a manufacturing method of the vibration system part for the speaker device.
Figures 5A, 5B, 5C:
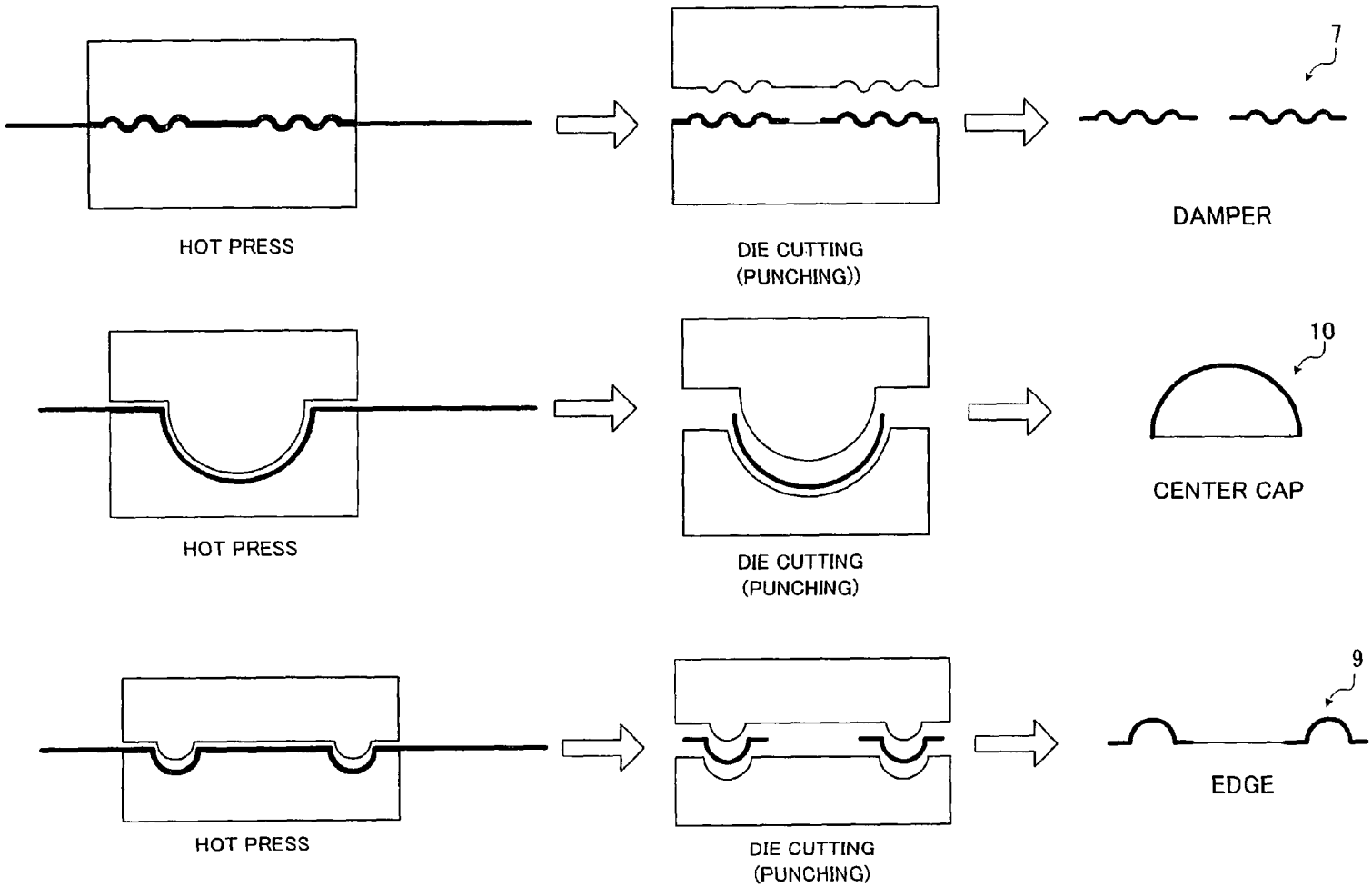
FIGS. 5A to 5C show diagrams of processes of forming various kinds of molded products corresponding to a process P1 shown in FIG. 4A.
Figure 6A:
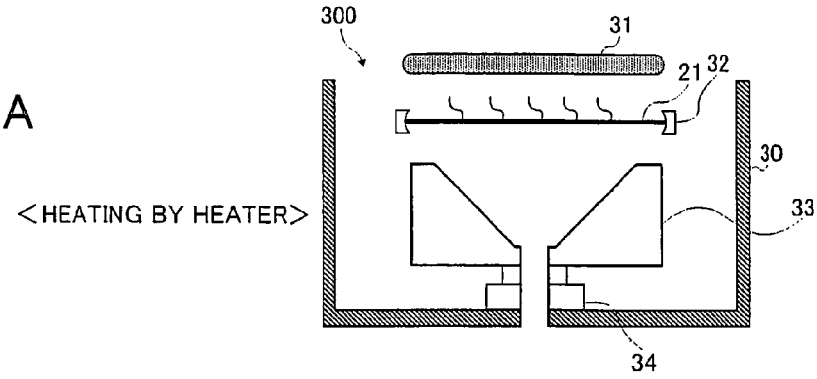
FIGS. 6A to 6C show diagrams of processes according to a vacuum suction forming method corresponding to the forming process S3 shown in FIG. 3.
Figure 6B:
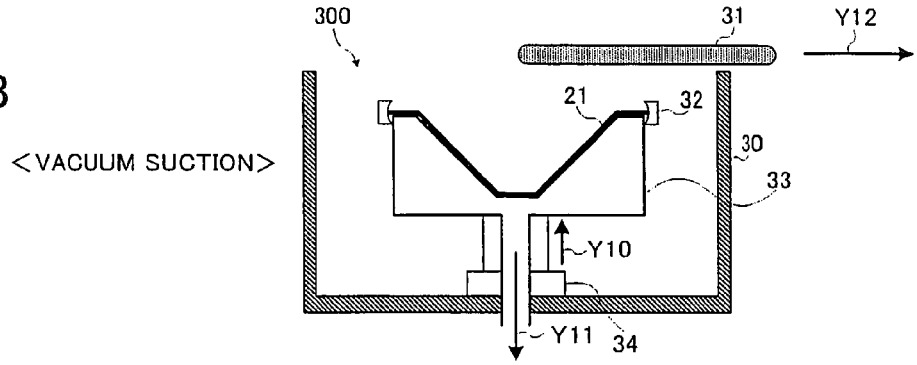
Figure 6C:
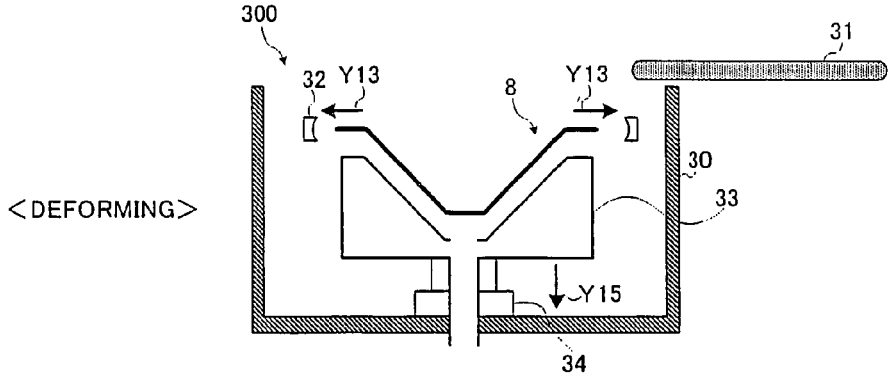

FIG. 3 shows a flow chart of the manufacturing method of the vibration system parts for the speaker device. FIG. 4A shows each of processes corresponding to an impregnating process S2 and a forming process S3 shown in FIG. 3. FIGS. 5A to 5C show diagrams of processes corresponding to the process S3 shown in FIG. 3 and a process shown by a broken-line area P1 shown in FIG. 4A, respectively. FIGS. 6A to 6C show forming process diagrams by a vacuum suction forming method shown in FIG. 3.

First, the yarn of the basalt fiber having the predetermined thickness produced by the twist yarn or the roving yarn being the continuous long-fiber is woven, and a sheet-type woven fabric (base material) 20 is produced (base material producing process S1, the drawing thereof omitted). It is preferable that the thickness (average diameter) of the yarn of the basalt fiber used at this time is substantially 7 to 20 μm. Instead, the sheet-type woven fabric (base material) 20 including the non-woven fabric made of the basalt fiber may be produced by a known method (base material producing process S1, the drawing thereof omitted).

Next, the sheet-type base material 20 obtained in the above-mentioned process is impregnated with the thermosetting resin or the thermoplastic resin such as the phenol resin (impregnating process S2). Afterward, the impregnated sheet-type base material 20 is dried by the hot-air.

Next, the sheet-type base material 20 dried by the hot-air is formed into a cone shape by the hot press forming. Subsequently, in a die cutting process, a predetermined portion of the sheet-type base material 20 formed into the cone shape is punched, and the diaphragm 8 formed into the cone shape shown in FIG. 1 is produced (forming process S3). Similarly, in the forming process S3, the damper 7, the center cap 10 and the edge 9, which are formed into the shapes shown in FIG. 1, are produced, respectively, as shown in FIGS. 5A to 5C. In that case, however, it is necessary that metal molds appropriate for those molded products should be used.

In the above-mentioned forming process S3, the hot press forming method is employed as the forming method of various kinds of vibration system parts for a speaker device. Instead, in the present invention, a vacuum suction forming method can be also employed as the forming method of the various kinds of the vibration system parts for the speaker device. Now, a description will be given of a method of forming the diaphragm 8 as an example of the vibration system parts for the speaker device by the vacuum suction forming method, with reference to FIGS. 6A to 6C.

In the forming process S3, the vibration system part for the speaker device is formed by a vacuum suction forming device 300.

As shown in FIGS. 6A to 6C, the vacuum suction forming device 300 includes a movable heater 31, a pair of clamps 32 sandwiching a molding base, a metal mold 33 formed into a predetermined shape, and a cylinder mechanism 34 moving the metal mold 33 in the up-and-down direction. The pair of clamps 32, the metal mold 33 and the cylinder mechanism 34 are housed in a housing 30.

First, the above-mentioned sheet-type base material 20 dried by the hot-air is formed into a predetermined size in advance. Subsequently, as shown in FIG. 6A, the formed base material 21 is sandwiched by the pair of clamps 32 and heated by the heater until it reaches a predetermined temperature to be softened.

Next, as shown in FIG. 6B, when the base material 21 becomes soft, the metal mold 33 is lifted up to a predetermined position in the direction of an arrow Y10 by the cylinder mechanism 34, and the base material 21 being the molding base is attached to the metal mold 33. Then, by a vacuum pump (not shown), the vacuum suction is executed in the direction of an arrow Y11. By the vacuum suction, the base material 21 is formed into the cone shape. At this time, the heater 31 is moved in the direction of an arrow Y12.

Next, as shown in FIG. 6C, when the temperature of the base material 21 formed into the cone shape decreases to some extent, the metal mold 33 is moved down to an initial position in the direction of an arrow Y15 by the cylinder mechanism 34. Subsequently, the fixing by the pair of clamps 32 is released (see the arrow Y13), and the molded product is taken out from the vacuum suction forming device 300. In this manner, the diaphragm 8 shown in FIG. 1 is formed. Similarly, by the above-mentioned process, the damper 7, the center cap 10 and the edge 9 shown in FIG. 1 are formed. In that case, however, it is necessary to use the metal molds appropriate for those molded products.

Next, by a known method, the lamination member, such as the paper, the foam material, the resin or the film, is selectively laminated (coated) on the surfaces of the vibration system parts for the speaker device obtained in the above-mentioned forming process S3 as shown in FIG. 4B (laminating process S4).

By the above-mentioned respective processes, the vibration system parts for the speaker device of the present invention are manufactured. The vibration system parts for the speaker device thus manufactured have the above-mentioned operation and effect.

The invention may be embodied on other specific forms without departing from the spirit or essential characteristics thereof. The present embodiments therefore to be considered in all respects as illustrative and not restrictive, the scope of the invention being indicated by the appended claims rather than by the foregoing description and all changes which come within the meaning an range of equivalency of the claims are therefore intended to embraced therein.

The entire disclosure of Japanese Patent Application No. 2005-123620 filed on Apr. 21, 2005 including the specification, claims, drawings and summary is incorporated herein by reference in its entirety.

What is claimed is:

1. A vibration system part for a speaker device, comprising:

a woven or non-woven fabric including fibers, wherein the fibers have basalt as a material, and a diameter of the fibers is within a predetermined range, and wherein a Young's Modulus and an internal loss of the vibration system part are large compared to a Young's Modulus and an internal loss of a comparative vibration system part formed by replacing the fiber of the vibration system part with a fabric of glass fibers, a density of the glass fibers being substantially 2540 kg/m$^3$, an elastic modulus of the glass fibers being substantially 7200 N/mm$^2$, and a diameter of each of the glass fibers being substantially within the predetermined range.

2. The vibration system part for the speaker device according to claim 1, wherein a sound speed of the vibration system part is large compared to a sound speed of the comparative vibration system part.

3. The vibration system part for the speaker device according to claim 2, wherein a specific gravity of the vibration system part is large compared to a specific gravity the comparative vibration system part.

4. The vibration system part for the speaker device according to claim 3, wherein the woven or non-woven fabric includes a continuous long fiber composed of a plurality of the fibers having basalt as the material, the diameter of the continuous long fiber being within the predetermined range.

5. The vibration system part for the speaker device according to claim 4, wherein the continuous long fiber is one of a twist yarn and a roving yarn.

6. The vibration system part for the speaker device according to claim 5, wherein one of i) a strength of the continuous long fiber is large compared to a strength of the glass fiber, and ii) a rigidity of the continuous long fiber is large compared to a rigidity of the glass fiber.

7. The vibration system part for the speaker device according to claim 6, wherein an elastic modulus of the continuous long fiber is large compared to the elastic modulus of the glass fiber.

8. The vibration system part for the speaker device according to claim 7, wherein an internal loss of a component material composing the continuous long fiber is large compared to an internal loss of a component material composing the glass fiber.

9. The vibration system part for the speaker device according to claim 8, wherein a shift between the fibers having the basalt as the material or a shift between the continuous long fibers generates the internal loss.

10. The vibration system part for the speaker device according to claim 9, wherein a hygroscopic property of the continuous long fiber is small compared to a hygroscopic property of the glass fiber, and wherein a deformation amount of the vibration system part in the high temperature and high humidity atmosphere is small.

11. The vibration system part for the speaker device according to claim 10, further comprising:

one of thermosetting resin and thermoplastic resin attached on the fibers of the woven fabric or non-woven fabric.

12. The vibration system part for the speaker device according to claim 11, further comprising a lamination member covering the woven fabric or non-woven fabric.

13. The vibration system part for the speaker device according to claim 11, wherein an upper limit of the predetermined range is substantially 20 μm.

14. The vibration system part for the speaker device according to claim 13, wherein a lower limit of the predetermined range is substantially 7 μm.

15. A speaker device comprising the vibration system part according to claim 1, further comprising:

a frame;

a magnetic circuit;

a voice coil;

a voice coil supporting member for supporting the voice coil;

a diaphragm;

an edge; and a damper, wherein the diaphragm is the vibration system part, wherein the diaphragm has an annular and cone shape, wherein an inner peripheral edge portion of the diaphragm is connected to an outer peripheral wall of the voice coil supporting member, wherein an outer peripheral edge portion of the diaphragm is connected to the frame through the edge, and wherein the voice coil supporting member is supported to the frame through the damper.

16. The speaker device according to claim 15, further comprising a center cap.

17. The speaker device according to claim 16, wherein the magnetic circuit includes a yoke, a magnet and a plate.

18. The speaker device according to claim 17, wherein a hygroscopic property of the glass fiber is substantially 1.0%.

19. A method of manufacturing a vibration system part for a speaker device, comprising:

impregnating a woven fabric or a non-woven fabric made of basalt fibers produced by twist yarn or roving yarn being continuous long-fiber with an impregnation material of one of thermosetting resin and thermoplastic resin such that shifts of the basalt fibers generate an internal loss; and forming the impregnated fabric by one of hot press and hot suction.

20. The manufacturing method of the vibration system part for the speaker device according to claim 19, further comprising the step of:

laminating a lamination member on a surface of the formed fabric.

* * * * *